US007426934B2

(12) United States Patent
Pardini

(10) Patent No.: US 7,426,934 B2
(45) Date of Patent: Sep. 23, 2008

(54) ANGULAR SUPPORT ELEMENT FOR A DISH-WASHING MACHINE

(75) Inventor: Gianluca Pardini, Lucca (IT)

(73) Assignee: Premark Feg L.L.C., Wilmington, DE (US)

( * ) Notice: Subject to any disclaimer, the term of this patent is extended or adjusted under 35 U.S.C. 154(b) by 654 days.

(21) Appl. No.: 10/964,487

(22) Filed: Oct. 13, 2004

(65) Prior Publication Data

US 2005/0103367 A1 May 19, 2005

(30) Foreign Application Priority Data

Oct. 17, 2003 (IT) ..... BO2003A0609

(51) Int. Cl.
*B08B 13/00* (2006.01)

(52) U.S. Cl. ..... 134/200; 134/201; 68/3 R

(58) Field of Classification Search ..... 68/3 R; 134/901, 200; 248/127–154; D6/195
See application file for complete search history.

(56) References Cited

U.S. PATENT DOCUMENTS 1,390,520 A * 9/1921 Fay ..... 68/122
1,473,301 A * 11/1923 Lapham ..... 134/110
1,611,767 A * 12/1926 Misner ..... 74/70
1,695,412 A * 12/1928 Cotterill ..... 134/139
1,736,949 A * 11/1929 Szekely ..... 248/129
1,770,664 A * 7/1930 Woehler ..... 248/146
D83,199 S * 2/1931 Hormes ..... D6/495
1,907,969 A * 5/1933 Hunter ..... 312/194
1,952,568 A * 3/1934 Schapp et al. ..... 134/105
2,047,346 A * 7/1936 Weston ..... 248/188.8
2,065,531 A * 12/1936 Kerr ..... 4/612
2,190,623 A * 2/1940 Benson ..... 248/150
2,204,686 A * 6/1940 Litle, Jr. ..... 248/146
2,224,558 A * 12/1940 Vincent ..... 248/150
2,248,007 A * 7/1941 Michaels ..... 219/510
2,254,651 A * 9/1941 Herold ..... 16/29
2,266,311 A * 12/1941 Rowland et al. ..... 68/238
2,274,077 A * 2/1942 Marzolf ..... 248/151
2,281,740 A * 5/1942 Blickhan ..... 248/150
2,323,571 A * 7/1943 Schroeder ..... 68/133
2,421,251 A * 5/1947 Dunham ..... 210/365
2,444,992 A * 7/1948 Kittel ..... 414/427
D155,369 S * 9/1949 Wallance ..... D6/495
2,636,199 A * 4/1953 Stanton et al. ..... 15/75
2,657,830 A * 11/1953 Briggs ..... 222/173
2,702,336 A * 2/1955 Wagner et al. ..... 219/433
D183,364 S * 8/1958 Monroe et al. ..... D6/495
2,884,650 A * 5/1959 Cooper ..... 4/680
3,079,120 A * 2/1963 Schwartz ..... 248/188

(Continued)

FOREIGN PATENT DOCUMENTS

DE 4443918 6/1996

(Continued)

*Primary Examiner*—Frankie L Stinson
(74) *Attorney, Agent, or Firm*—Thompson Hine LLP

(57) ABSTRACT

An angular support element for a dish-washing machine comprises, in a position corresponding to the washing compartment of the machine, one or more tubular portions, each of which has a concave wall without sharp corners or edges set facing the inside of the dish-washing machine; each of the tubular portions is made up of the coupling of a longitudinal external rolled section and a longitudinal internal rolled section by means of overlapping of respective fixing walls.

5 Claims, 2 Drawing Sheets

U.S. PATENT DOCUMENTS 3,304,121 A * 2/1967 Vincens et al. ..... 297/451.4
3,480,146 A * 11/1969 Barker, Jr. ..... 210/250
3,625,233 A * 12/1971 Southard ..... 134/165
3,646,618 A * 3/1972 Johnson ..... 4/599
4,214,670 A * 7/1980 Berger et al. ..... 220/606
4,359,250 A 11/1982 Jenkins
4,496,125 A * 1/1985 Walsh et al. ..... 248/188
5,441,708 A * 8/1995 Diccianni et al. ..... 422/292
6,108,829 A * 8/2000 Wadsworth ..... 4/541.1
7,284,579 B2 * 10/2007 Elgan et al. ..... 141/316

FOREIGN PATENT DOCUMENTS

EP 0711527 5/1996
EP 0903106 3/1999

* cited by examiner

ANGULAR SUPPORT ELEMENT FOR A DISH-WASHING MACHINE

The present invention relates to an angular support element for a dish-washing machine.

BACKGROUND OF THE INVENTION

Dish-washing machines generally comprise angular supports, which have a wall defining a right angle facing the inside of the machine.

The presence of these portions defining a right angle entails a drawback regarding the cleanliness of the portion itself because of the accumulation of dirt that is deposited in the corner and because of the difficulty of removing it.

In particular, in a dish-washing machine, the accumulation of dirt occurs in an area corresponding to the compartment in which washing and rinsing of the dishes takes place. In fact, in this area the dirt of the dishes can easily reach the walls in so far as it is carried there by the jet of washing water.

SUMMARY OF THE INVENTION

The purpose of the present invention is to provide an angular support element for a dish-washing machine, the technical characteristics of which are able to solve the problems of the known art in a simple and economically advantageous way.

The subject of the present invention is an angular support element for a dish-washing machine; said angular element being characterized in that it comprises at least one tubular portion, which includes a concave wall without sharp corners or edges, which faces the inside of the dish-washing machine.

According to a preferred embodiment, said tubular portion comprises a longitudinal external rolled section and a longitudinal internal rolled section coupled together, said internal rolled section having said concave wall.

BRIEF DESCRIPTION OF THE DRAWINGS

The example presented in what follows has a purely illustrative and non-limiting purpose in order to enable a better understanding of the invention, with the aid of the annexed plate of drawings, in which.

DETAILED DESCRIPTION OF THE INVENTION

Figure 1:
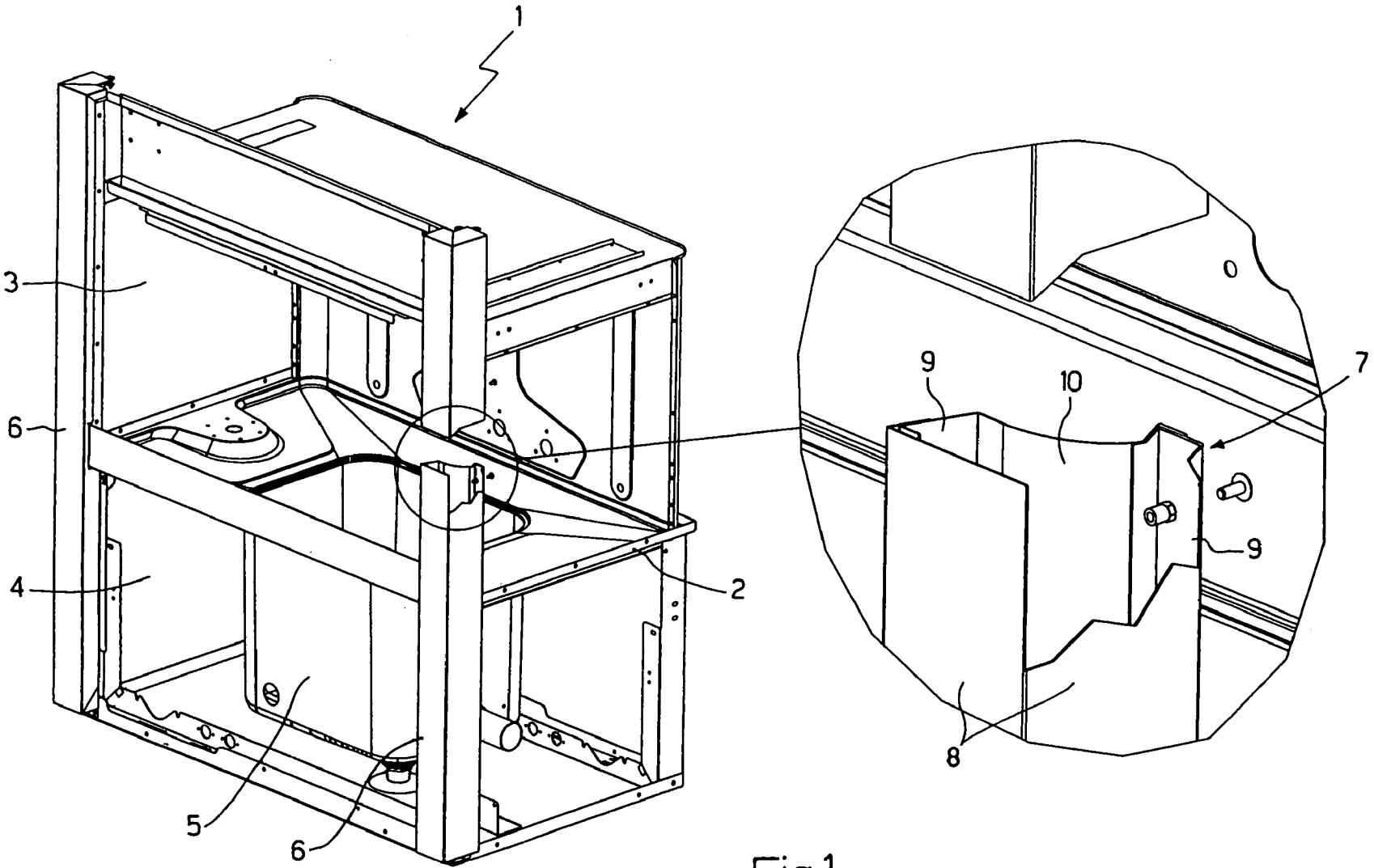
FIG. 1 is a perspective view of a dish-washing machine, with parts removed, which comprises a preferred embodiment of the angular elements according to the present invention.

In FIG. 1 designated as a whole by the reference number 1 is a dish-washing machine.

The dish-washing machine 1 comprises a supporting structure 2, which divides the dish-washing machine 1 itself into a top compartment 3, in which the operations of washing and rinsing are carried out, and a bottom compartment 4, in which a tank 5 is housed for collecting the washing and rinsing waters in such a way that the waters themselves may be set in circulation again.

The dish-washing machine 1 comprises two angular support elements 6, each of which is fixed to the supporting structure 2. In a position corresponding to the top compartment 3, as is highlighted by the enlarged detail of FIG. 1, each of the angular elements comprises a tubular portion 7.

The tubular portion 7 is defined laterally by: two plane external walls 8 arranged at right angles to one another; two plane fixing walls 9, each of which extends at right angles from a respective external wall 8; and a concave internal wall 10 extending from between the two fixing walls 9.

Figure 2:
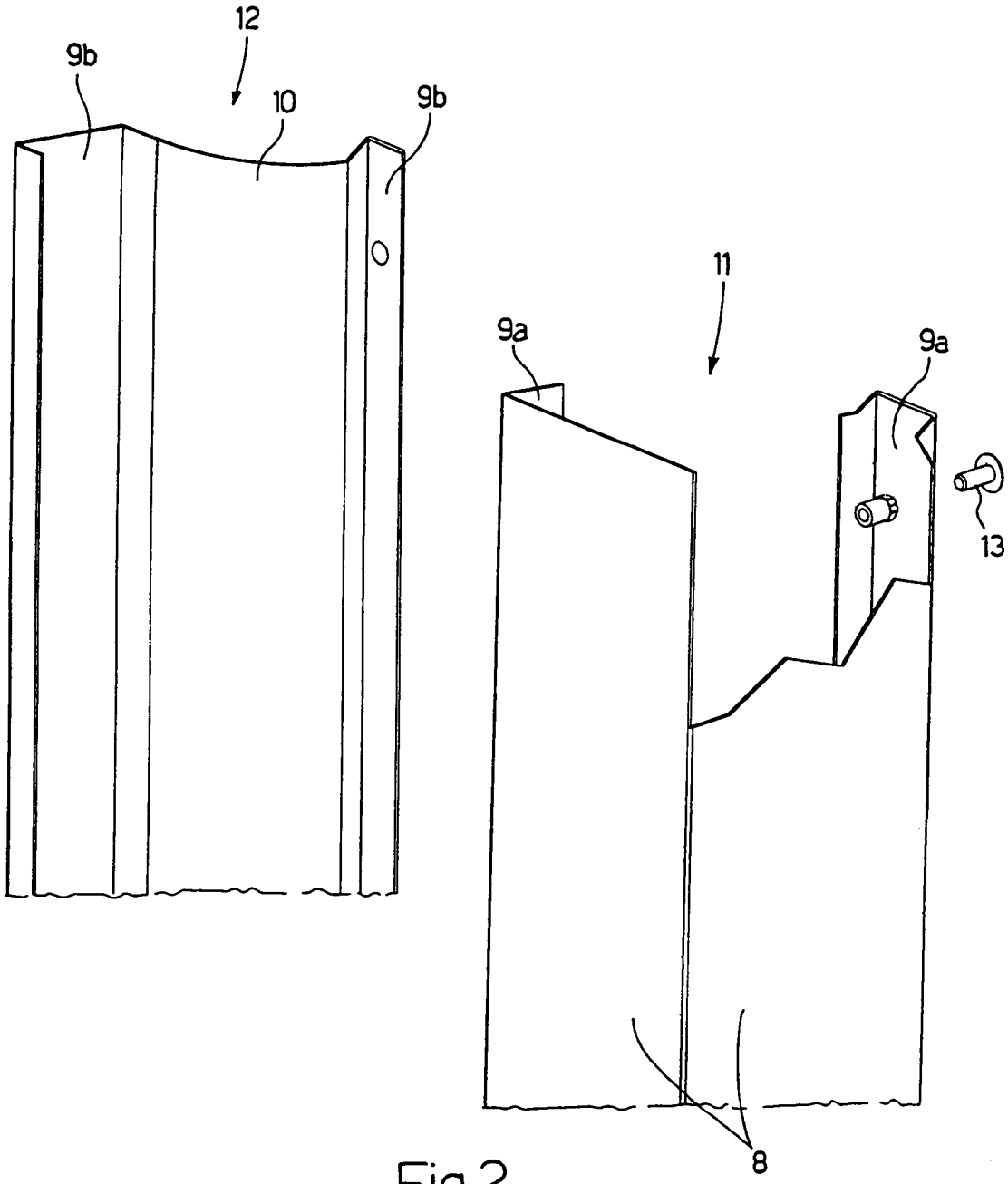
FIG. 2 illustrates an exploded view with parts removed of an angular element of FIG. 1.

As is illustrated in FIG. 2, the tubular portion 7 comprises an external rolled section 11 and an internal rolled section 12, which are coupled together to form the tubular portion 7 itself by means of an overlapping thereof in a position corresponding to the fixing walls 9 and a corresponding clamping with screws 13.

The external rolled section 11 comprises the two external walls 8 and at least part of the two fixing walls 9, in the form of external section plane fixing wall portions 9*a*, to enable overlapping and fixing with the internal rolled section 12.

The internal rolled section 12 comprises the concave wall 10 and part of the fixing walls 9, in the form of external section plane fixing wall portions 9*b*. In other words, whilst the external walls 8 and the internal concave wall 10 are supported, respectively, by the external rolled section 11 and by the internal rolled section 12, the fixing walls 9 derive from the overlapping of the wall portions 9*a* of the external rolled section 11 with the wall portions 9*b* of the internal rolled section 12.

Furthermore, whilst the external rolled section 11 extends throughout the height of the dish-washing machine 1, the internal rolled section 12 is coupled to the external rolled section 11 only in a position corresponding to the top compartment 3.

The angular element of the present invention makes available an internal surface without sharp edges, with the consequence that it is much easier to prevent the dirt from accumulating, thus at the same time preventing the problems set forth above.

It should moreover be pointed out that the fact that the angular element is obtained by coupling together an external rolled section and an internal rolled section renders the element itself modular, with the possibility of modifying it and of adapting it to particular requirements.

Finally, a further advantage of the angular element of the present invention is that the fixing of the two rolled sections is obtained by means of screws and not by means of welds, thus eliminating all the disadvantages that welding entails.

The invention claimed is:

1. A dishwashing machine comprising an angular support element; said angular support element being characterized in that it includes at least one tubular portion comprising a longitudinal external rolled section and a longitudinal internal rolled section coupled together; said internal rolled section having a concave wall without sharp corners or edges, which faces an inside of the dish-washing machine, the concave wall of said angular support element is positioned internal of the machine to be exposed to a washing and rinsing compartment of the machine during dish cleaning.

2. The dishwashing machine according to claim 1, characterized in that said external rolled section comprises two external section plane fixing wall portions and said internal rolled section comprises two internal section plane fixing wall portions, and said external rolled section and said internal rolled section are coupled together by overlapping of said external section plane fixing wall portions and said internal section plane fixing wall portions.

3. The angular element according to claim 2, characterized in that said internal section plane fixing wall portions and said external section plane fixing wall portions are fixed together by a plurality of screws.

4. The dishwashing machine according to claim 3, characterized in that said external rolled section comprises two external walls set at right angles to one another; each of the external walls having a respective one of the external section plane fixing wall portions extending at a right angle therefrom.

5. The dishwashing machine according to claim 4, characterized in that, in said internal rolled section, the internal section plane fixing wall portions extend on opposite sides of said concave wall.

* * * * *